US007770876B2

(12) United States Patent
Sasahara

(10) Patent No.: US 7,770,876 B2
(45) Date of Patent: Aug. 10, 2010

(54) CREASING DEVICE, POST-PROCESSING APPARATUS EQUIPPED THEREWITH, CREASING METHOD, IMAGE FORMING APPARATUS AND CREASE-ADDED PRINTING METHOD

(75) Inventor: Katsuya Sasahara, Izu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 4 days.

(21) Appl. No.: 12/107,351

(22) Filed: Apr. 22, 2008

(65) Prior Publication Data

US 2009/0062096 A1 Mar. 5, 2009

Related U.S. Application Data

(60) Provisional application No. 60/968,546, filed on Aug. 28, 2007.

(51) Int. Cl.

| | |
|---|---|
| ***B41L 43/00*** | (2006.01) |
| ***B41L 43/12*** | (2006.01) |
| ***B42C 1/00*** | (2006.01) |
| ***B42C 1/10*** | (2006.01) |
| ***B65H 33/04*** | (2006.01) |

(52) U.S. Cl. ..... 270/32; 270/37; 270/45; 270/51; 270/20.1; 270/58.07

(58) Field of Classification Search ..... 270/32, 270/37, 45, 51, 20.1, 58.07
See application file for complete search history.

(56) References Cited

U.S. PATENT DOCUMENTS

| | | | | |
|---|---|---|---|---|
| 2,444,050 | A * | 6/1948 | Knowlton et al. | 493/62 |
| 4,524,962 | A * | 6/1985 | Davenport et al. | 270/21.1 |
| 6,905,118 | B2 | 6/2005 | Yamada et al. | |

FOREIGN PATENT DOCUMENTS

| | | | |
|---|---|---|---|
| JP | 07013862 | U * | 3/1995 |
| JP | UM 7-13862 | | 3/1995 |
| JP | P2003-81529 | A | 3/2003 |

* cited by examiner

*Primary Examiner*—Gene Crawford
*Assistant Examiner*—Yolanda Cumbess
(74) *Attorney, Agent, or Firm*—Patterson & Sheridan, LLP

(57) ABSTRACT

A creasing device includes a feeding mechanism, a creasing mechanism, sensors, and an aligning mechanism. The feeding mechanism conveys paper on which an image has been formed in a post-processing apparatus main body direction. The creasing mechanism makes a crease on the paper. The sensors detect a deviation of the paper with respect to the feeding direction. The aligning mechanism, based on an amount of deviation in a result of a detection by the sensors, causes the creasing mechanism to rotate in such a way that the creasing mechanism is aligned parallel to a crease direction of the paper.

7 Claims, 4 Drawing Sheets

CREASING DEVICE, POST-PROCESSING APPARATUS EQUIPPED THEREWITH, CREASING METHOD, IMAGE FORMING APPARATUS AND CREASE-ADDED PRINTING METHOD

CROSS REFERENCE TO RELATED APPLICATIONS

This application claims the benefit of U.S. Provisional Application No. 60/968,546, field Aug. 28, 2007.

BACKGROUND OF THE INVENTION

1. Field of the Invention

The present invention relates to a creasing device which can make a crease on paper, and a post-processing apparatus, as well as to a creasing method, an image forming apparatus and a crease-added printing method.

2. Description of the Related Art

In Japanese Unexamined Patent Publication No. 2003-81529, a post-processing apparatus which can fold paper on which an image is formed in, for example, an accordion shape is disclosed. The post-processing apparatus includes a conveying path along which the paper is fed, a conveying roller for feeding the paper, a folding roller for folding the paper in the accordion shape and, in the event that the paper deviates with respect to the conveying path, a correcting mechanism for correcting an angle of the paper, and a sensor for detecting an extent of the deviation of the paper. The correcting mechanism is provided on the conveying roller or the folding roller.

In the post-processing apparatus, in the event that it is detected by the sensor that the paper is deviating with respect to the conveying path, the correcting mechanism operates an installation angle of the conveying roller or the folding roller. The correction is carried out in a condition in which the conveying roller or the folding roller is gripping the paper to correct the deviating paper so as to be straight with respect to the conveying path.

In the U.S. Pat. No. 6,905,118, a post-processing apparatus is disclosed, which is configured in such a way that, after causing the paper to pass through a nipping unit of a pair of folding rollers and making a crease, furthermore, the crease is sharpened by applying pressure to the crease portion in a fold reinforcing roller 400.

However, with the post-processing apparatus described in the Japanese Unexamined Patent Publication No. 2003-81529, as a structure which causes the conveying roller or the folding roller to rotate is adopted, there has been a possibility that a structure of the correcting mechanism becomes large, and also that the post-processing apparatus as a whole becomes large. Also, as the paper is caused to rotate in a condition in which it is held down by a roller, it is sufficient that the paper rotates correctly together with the roller, but there has been a possibility that, in a case in which the paper slips on the roller, and the rotation of the paper is not carried out sufficiently, correction cannot be done correctly. Furthermore, in a case of folding a plurality of sheets of paper by means of the roller, as the crease becomes indistinct, there has been a possibility that an appearance deteriorates when finished. With the post-processing apparatus described in the U.S. Pat. No. 6,905,118, the fold reinforcing roller being necessary, there has been a problem that a structure becomes complex.

BRIEF SUMMARY OF THE INVENTION

An object of the invention is to provide a creasing device which, with a simple structure, can improve a visual appearance of paper when finished.

An object of the invention is to provide a post-processing apparatus which, with a simple structure, can improve the visual appearance of the paper when finished.

An object of the invention is to provide a creasing method which can improve the visual appearance of the paper when finished.

An object of the invention is to provide an image forming apparatus which, with a simple structure, can improve the visual appearance of the paper when finished.

An object of the invention is to provide a crease-added printing method which can improve the visual appearance of the paper when finished.

In order to achieve the above-described object, one aspect of the invention is directed to a creasing device including a feeding mechanism for feeding paper on which an image is formed in a feeding direction, a creasing mechanism for making a crease on the paper, sensors for detecting a deviation of the paper with respect to the feeding direction, and an aligning mechanism which, based on a result of a detection by the sensors, causes the creasing mechanism to rotate in such a way that the creasing mechanism is aligned with the paper.

In order to achieve the above-described object, one aspect of the invention is directed to a post-processing apparatus including a creasing device for making a crease on paper, and a folding process mechanism which performs a folding process on the paper on which the crease has been made by the creasing device. The creasing device includes a feeding mechanism for feeding the paper on which an image is formed in a feeding direction, a creasing mechanism for making a crease on the paper, sensors for detecting a deviation of the paper with respect to the feeding direction, and an aligning mechanism which, based on a result of a detection by the sensors, causes the creasing mechanism to rotate in such a way that the creasing mechanism is aligned with the paper.

In order to achieve the above-described object, one aspect of the invention is directed to a creasing method used in a creasing device including a creasing mechanism for making a crease on paper, detection sensors which detect a deviation of the paper with respect to a feeding direction, and an aligning mechanism which causes the creasing mechanism to rotate. The method detects, by means of the detection sensors, the deviation with respect to the feeding direction of the paper fed toward the feeding direction and, as well as stopping the feeding of the paper, after causing the creasing mechanism to revolve in relation to the deviation of the paper, and aligning the creasing mechanism parallel to a fold direction of the paper by means of the aligning mechanism, creases the paper by means of the creasing mechanism.

In order to achieve the above-described object, one aspect of the invention is directed to an image forming apparatus including an image formation unit for forming an image on paper, and a post-processing apparatus which performs a post-processing on the paper. The post-processing apparatus includes a creasing device for making a crease on the paper, and a folding process device which performs a folding process on the paper on which the crease has been made by the creasing device. The creasing device includes a feeding mechanism for feeding the paper on which an image is formed in a feeding direction, a creasing unit for making a crease on the paper, sensors which detect a deviation of the paper with respect to the feeding direction, and an aligning mechanism which, based on a result of a detection by the sensors, causes the creasing unit to revolve in such a way that the creasing unit is aligned with a conveying direction of the paper.

In order to achieve the above-described object, one aspect of the invention is directed to a crease-added printing method used in an image forming apparatus including an image formation unit for forming an image on paper, a creasing mechanism for making a crease on the paper, sensors which detect a deviation of the paper with respect to the feeding direction, and an aligning mechanism which causes the creasing mechanism to rotate. The method forms the image on the paper by means of the image formation unit, detects, by means of the detection sensors, the deviation with respect to the feeding direction of the paper fed toward the feeding direction and, as well as stopping the feeding of the paper, after causing the creasing mechanism to revolve in relation to the deviation of the paper, and aligning the creasing mechanism parallel to a fold direction of the paper by means of the aligning mechanism, makes a crease line on the paper by means of the creasing mechanism.

In order to achieve the above-described object, one aspect of the invention is directed to a crease-added printing method used in an image forming apparatus including an image formation unit for forming an image on paper, and a post-processing apparatus having a creasing device for making a crease on the paper, a folding process device which performs a folding process on the paper on which the crease has been made by the creasing device, and an aligning mechanism which adjusts a relative position of the paper with respect to the creasing device by causing an angle of one of the creasing device or the paper to rotate. The method forms the image on the paper in the image formation unit, adjusts the relative position of the paper with respect to the creasing device by means of the aligning mechanism, forms a crease line on the paper by means of the creasing device, and forms an actual crease on the paper by means of the folding process device.

According to the invention, it is possible to provide a creasing device which, with a simple structure, can improve the visual appearance of the paper when finished.

Objects and advantages of the invention will become apparent from the description which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

Figure 1:
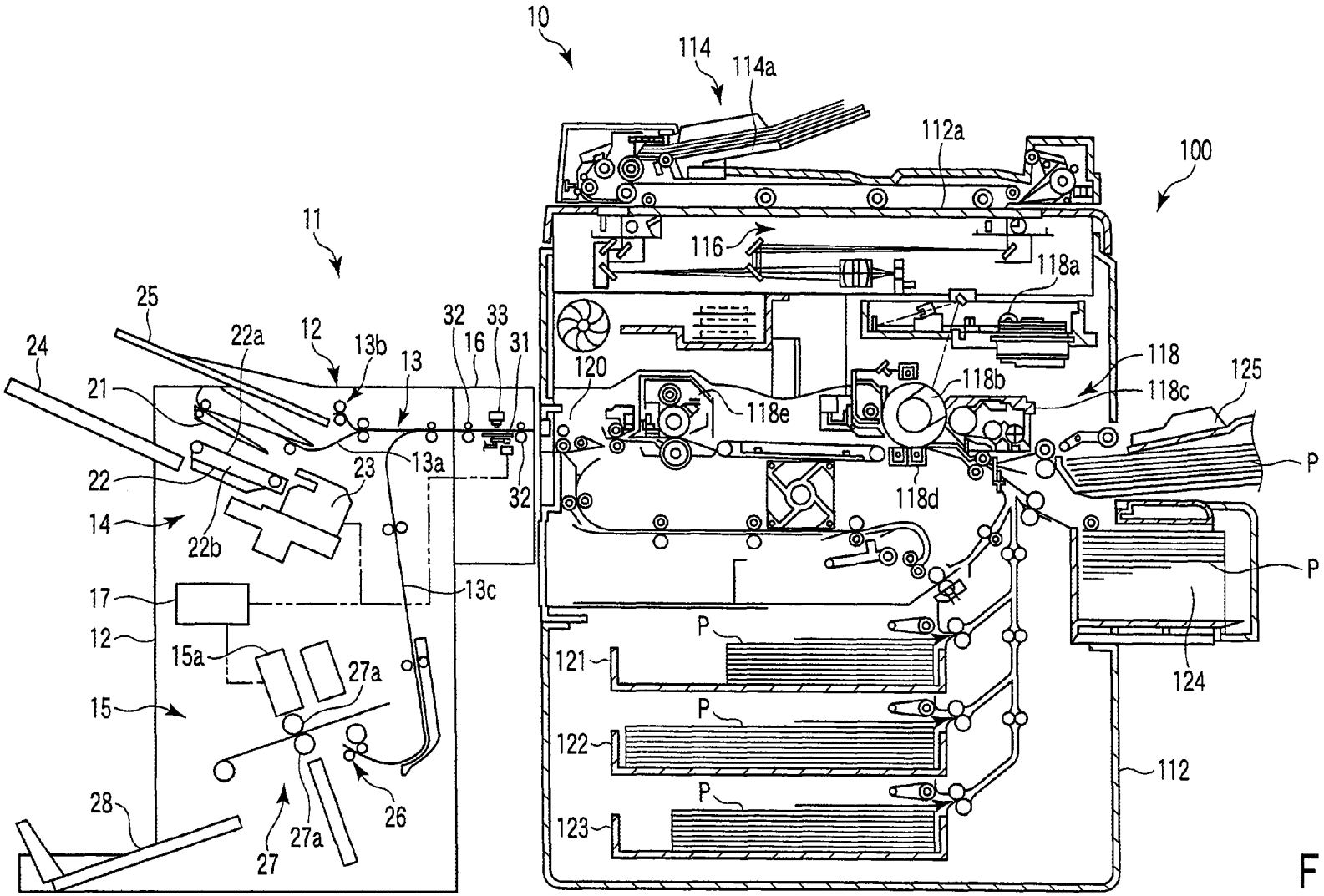
FIG. 1 is a sectional view showing a post-processing apparatus and an MFP main body according to a first embodiment.

Hereafter, a detailed description will be given of an embodiment of the invention, while referring to the drawings.

In FIG. 1, as an image forming apparatus, an outline view of a Multi Function Peripheral (hereafter, called simply an MFP) 10 is shown. The MFP 10 is configured of a post-processing apparatus 11 according to the embodiment of the invention, a digital copying machine 100 to which the post-processing device 11 is connected, and the like. The digital copying machine 100 is one example of an MFP main body to a printing unit in the invention.

The digital copying machine 100 has an apparatus outer shell 112 and an original document platform 112*a* made of a transparent glass sheet on an upper surface of the outer shell 112. An automatic original document feeding device 114 (hereafter, called simply an ADF 114) is provided so as to be openable and closable on top of the original document platform 112*a*. The ADF 114 operates in such a way as to automatically feed original documents D to a predetermined position on the original document platform 112*a*.

For example, after setting the original documents D in a paper feeding tray 114*a* of the ADF 114, and setting whether to perform a stapling process, a type of the stapling process, a number of copies, a paper size and the like, on pressing a copying start switch, the original documents D of the paper feeding tray 114*a* are automatically conveyed one by one to an original document reading position on the original document platform 112*a* and, after the original documents are read, automatically discharged at an appropriate timing.

A scanning unit 116, an image forming unit 118, cassettes 121, 122 and 123 on which is loaded recording paper P (hereafter, called simply paper P), and the like, are arranged inside the outer shell 112. Also, a large capacity feeder 124, in which is housed a large volume of paper of the same size, and a manual feed tray 125, are attached to a right wall of the outer shell 112 in the figure. Furthermore, the paper post-processing apparatus 11, to be described hereafter, is connected to a left wall of the outer shell 112 in the figure.

The scanning unit 116 illuminates and scans an original document D which is conveyed to the original document reading position on the original document platform 112*a* by the ADF 114, reads and photoelectrically converts catoptric light therefrom, and acquires image information of the original document D.

A printing unit 118 urges a laser device 118*a*, based on the image information read by the scanning unit 116, and forms an electrostatic latent image on a peripheral surface of a photoconductive drum 118*b*, based on the image information. Then, the printing unit 118, via a developing device 118*c*, supplies toner to the electrostatic latent image on the photoconductive drum 118*b*, visualizing it, and transfers the toner image to the paper P by means of a transfer charger 118*d*. At this time, the paper P is fed from one of the cassettes 121, 122 and 123, the large capacity feeder 124 and the manual feed tray 125.

Furthermore, the printing unit 118 feeds the paper P to which the toner image has been transferred to a fixing device 118*e*, fixes the toner image to the paper P by heat fusing, and discharges the paper P to the post-processing apparatus 11 via a discharging unit 120. The paper P discharged via the discharging unit 120 corresponds to a sheet of the invention.

Hereafter, a description will be given of the post-processing apparatus 11.

The post-processing apparatus 11, being disposed between a cabinet 12, which configures a frame of a post-processing apparatus main body, and the digital copying machine 100 (the MFP 10), includes a creasing device 16 attached to an exterior of the cabinet 12, a first post-processing mechanism 14, which carries out a stapling and sorting process, and a second post-processing mechanism 15, which carries out an interim binding and interim folding process, housed inside the cabinet 12, a controller 17, which controls the first post-processing mechanism 14, the second post-processing mechanism 15, and the creasing device 16. The controller 17, being equipped with a microprocessor, a memory and the like, has a computer function of centrally controlling the first post-processing mechanism 14, the second post-processing mechanism 15, and the creasing device 16.

The first post-processing mechanism 14 is mainly for applying a stapling process to the paper P. The stapling process in this case refers to a process of aligning one edge of an accumulated plurality of sheets of the paper P and binding them together. The first post-processing mechanism 14 includes a holding tray 21 for temporarily holding the paper P which is conveyed in order to continuously carry out the stapling process, via a first conveying path 13*a* branching off an entrance conveying path 13 which receives and conveys the paper P which is discharged from the creasing device 16, until a discharge of paper from a stapling process loading unit 22*a* is completed, a discharge conveying device 22*b* for discharging the paper P from the stapling process loading unit 22*a*, a stapler 23 which carries out the stapling process on the paper P, and a first discharge tray 24 for discharging the paper P to which the stapling process has been applied. Furthermore, the first post-processing mechanism 14 includes a second discharge tray 25, and can load the paper P discharged via a second conveying path 13*b* branching off the entrance conveying path 13 which receives and conveys the paper P discharged from the creasing device 16.

The second post-processing mechanism 15, being an example of a saddle unit, can, for example, perform a process on the paper P of carrying out the interim binding with an interim binding stapler 15*a*, and folding the paper P in two (a center folding). The second post-processing mechanism 15 includes a conveying device 26 for receiving and conveying the paper P which is conveyed via a third conveying path 13*c* branching off the entrance conveying path 13, a folding mechanism 27 for applying the folding process to the paper P, and a third discharge tray 28 for discharging the paper P to which the folding process has been applied. The folding mechanism 27 has a pair of rollers 27*a* for nipping and folding the paper P.

The creasing device 16 is provided in a position between the MFP 10 and the post-processing apparatus main body. The creasing device 16 is for forming a crease in advance in the paper P, prior to applying the folding process to the paper P in the post-processing mechanism 15 of the post-processing apparatus main body. An image is formed by the MFP 10 on the paper P which is fed to the creasing device 16.

The creasing device 16 includes a conveying path 31 along which the paper P is fed, a feeding mechanism 32 for feeding the paper P in a feeding direction F, a creasing mechanism 33, which is one example of a creasing unit which makes a crease in the paper P, sensors 34, which detect a deviation (a skew) of the paper P which is fed along the conveying path 31, and an aligning mechanism 35, which causes the creasing mechanism 33 to revolve in such a way that the creasing mechanism 33 is aligned parallel facing a straight line perpendicular to a conveying direction of the paper P. The feeding mechanism 32 is configured of, for example, a roller formed of rubber or the like, a roller drive motor and a drive transmission unit.

Figure 2:
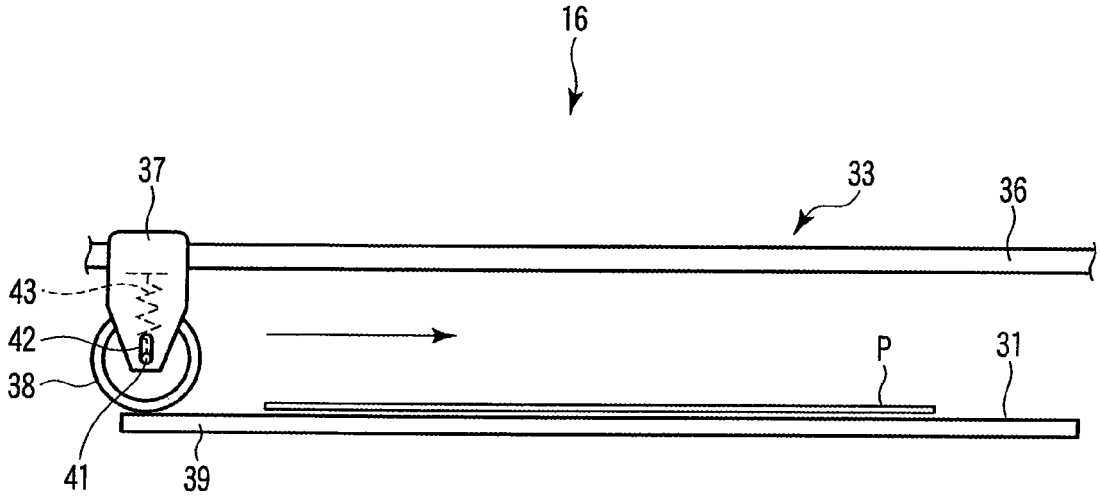
FIG. 2 is a side schematic view showing a creasing device of the post-processing apparatus shown in FIG. 1.

As shown in FIG. 2, the creasing mechanism 33 includes a guide shaft 36, crossing in a lateral direction perpendicular to the feeding direction F of the paper P, an attachment unit 37, which is movable along the guide shaft 36, a creasing blade 38, which is rotatably held by the attachment unit 37, and a rectangular backup plate 39, which is provided in a position opposing the creasing blade 38.

The creasing blade 38 forms a circular disc shape. The creasing blade 38, moving while rotating on the paper P, can form a crease in the paper P. The sensors 34 are disposed as a pair, in separate positions in a direction perpendicular to the feeding direction F of the paper P. Each sensor 34 detects a leading edge of the paper P fed from the MFP 10, and calculates an amount of deviation (skew) from a time difference thereof. The sensors 34 are disposed at a width at which they can reliably detect the paper P used. The sensors 34 configured in this way are one example of a detection sensor which can detect the deviation of the paper P with respect to the feeding direction F. Although, in the embodiment, it is arranged in such a way that the rectangular backup plate 39 is provided, not being limited to this, it is also acceptable to arrange in such a way as to combine the backup plate 39 with the flattened conveying path 31.

The attachment unit 37 is formed in such a way as to be able to selectively hold one of a plurality of creasing blades 38 of different kinds. The attachment unit 37 includes a shaft 41, which rotatably supports the creasing blade 38, a slit 42 through which the shaft 41 is passed, and a spring mechanism 43 for elastically supporting the shaft 41. The shaft 41, in a condition in which it holds the creasing blade 38, can advance and retreat up and down along the slit 42. The spring mechanism 43, pressing the shaft 41 in a lower extreme direction of the slit 42, can elastically support the creasing blade 38. The attachment unit 37, by means of a drive of an unshown motor, can move along the guide shaft 36 via a power transmission mechanism such as, for example, a rack and pinion.

Figure 3:
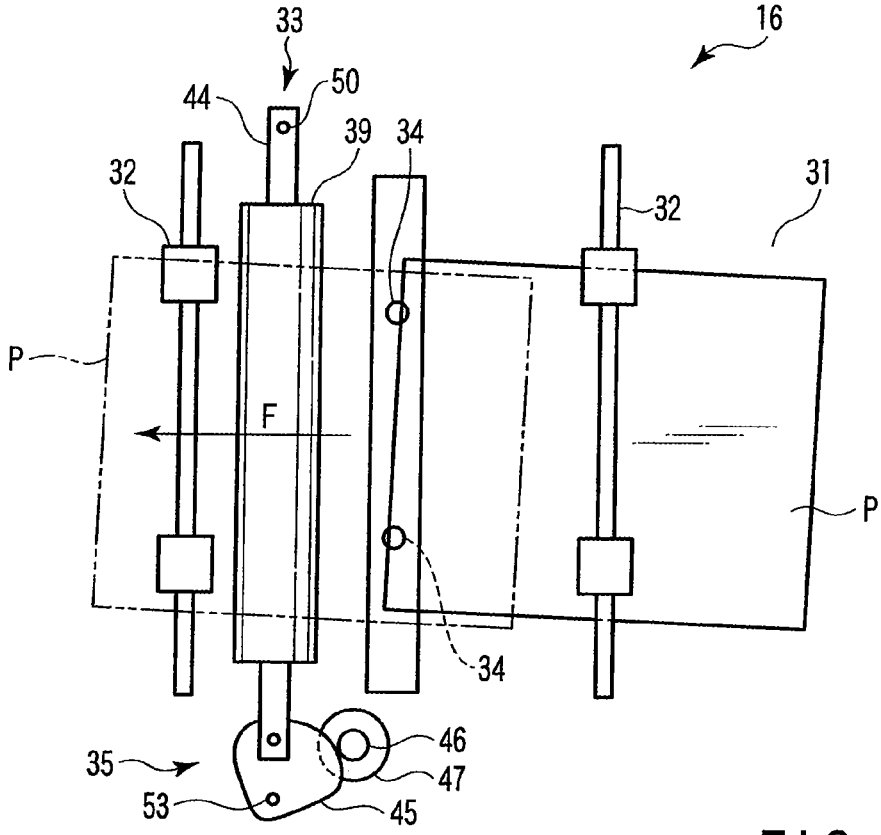
FIG. 3 is a top schematic view showing the creasing device shown in FIG. 2 from above.

The aligning mechanism 35 is one example of an aligning unit which, based on a result of a detection by the sensors 34, can revolve the creasing mechanism 33 in such a way that it is aligned with the deviation (skew) of the paper P. As shown in FIG. 3, the aligning mechanism 35 includes a central shaft 50, a rod-shaped swiveling member 44 which, as well as supports the creasing mechanism 33, swivels centered on the central shaft 50, a link member 45 for swiveling the swiveling member 44, a gear 46, which meshes with an external peripheral portion of the link member 45, and a motor 47 for causing the gear 46 to rotate. The link member 45 is formed in a fan shape. The link member 45 can rotate centered on a spindle 51. The link member 45 has a plurality of teeth on an external peripheral portion thereof, and the plurality of teeth mesh with teeth of the gear 46. As one example of the motor 47, a stepping motor is used.

Figure 4:
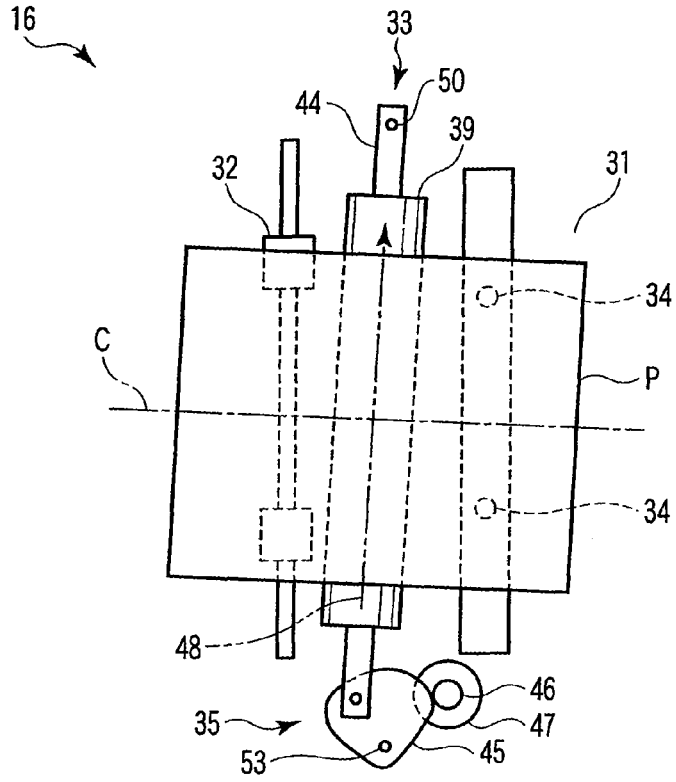
FIG. 4 is a top schematic view showing a creasing mechanism of the creasing device shown in FIG. 3, in a condition in which it is caused to rotate so as to be aligned with the paper.

The method of creasing the paper P using the creasing device 16 is described next by referring to FIGS. 3 and 4. As shown in FIG. 3, in a case in which the paper P is slanted with respect to the feeding direction F, the amount of deviation (skew) of the paper P is detected by the sensors 34.

Figure 5:
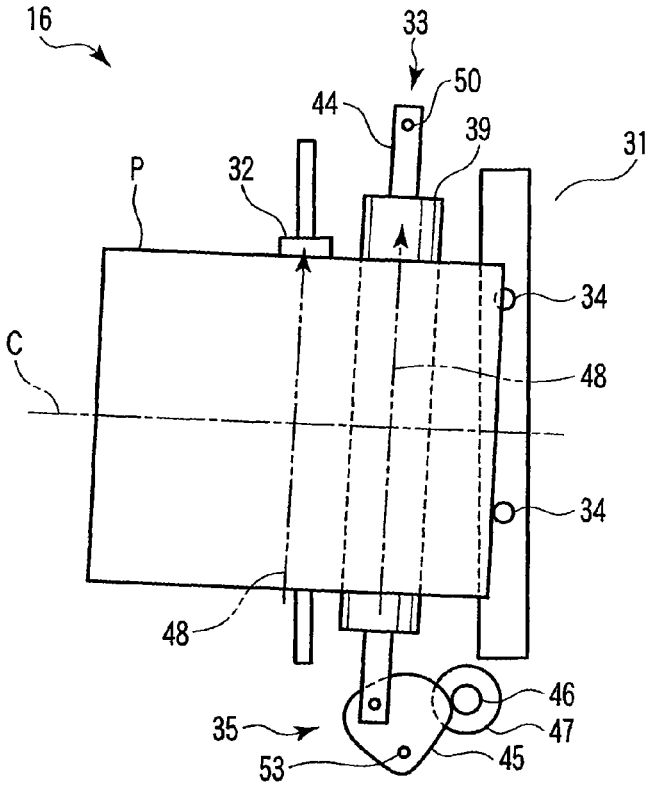
FIG. 5 is a top schematic view showing, in the condition in which the creasing mechanism of the creasing device shown in FIG. 3 is caused to rotate so as to be aligned with the paper, a condition of forming two creases on the paper.

When a predetermined crease position (for example, a central portion) of the paper P is positioned in a center of the creasing mechanism 33, the controller 17 simultaneously stops the conveying of the paper P by the feeding mechanism 32. Furthermore, the controller 17, in accordance with the amount of deviation of the paper P, rotationally drives the motor 47 of the aligning mechanism 35. By this means, for example, as shown in FIG. 4, in a case in which the paper P deviates to an upper side, in the plane of the figure, with respect to the feeding direction F, the creasing mechanism 33 swivels in a left direction, in the plane of the figure, centered on the central shaft 50. By this means, the creasing mechanism 33 being disposed in such a way as to be perpendicular to a central line C of the paper P, a traveling direction of the creasing mechanism 33 is aligned parallel to a crease direction of the paper P. In this condition, the creasing blade 38 moves along the guide shaft 36 in a direction perpendicular to the central line C of the paper P. By so doing, as shown by a two-dot chain line in FIG. 4, one crease line 48 is formed in the central portion of the paper P. In a case of accordion folding the paper P, as shown by two-dot chain lines in FIG. 5, crease lines 48 are formed in two places; the central portion of the paper P, and another portion away from the central portion. In FIGS. 3 to 5, an illustration of the creasing blade 38 and the like is omitted.

After the crease line 48 has been formed in this way, the feeding mechanism 32 starts up again, and the paper P is fed to the second post-processing mechanism 15 of the post-processing apparatus main body 12. In the post-processing apparatus main body, a half folding process is actually performed on the creased paper P. As necessary, the paper on which the interim binding process has been carried out on the crease line 48 is folded in half, and discharged into the third discharge tray 28. Also, by embedding an accordion folding mechanism (not shown) in the second post-processing mechanism 15, or replacing therewith, an accordion folding process is carried out on the creased paper P, and it is discharged into the third discharge tray 28.

According to the embodiment, the post-processing apparatus 11 is equipped with the creasing device 16 for creasing the paper P, and the folding process device 12 for performing the folding process on the paper P which has been creased by the creasing device 16, the creasing device 16 is equipped with the feeding mechanism 32 for feeding the paper P on which the image has been formed in the feeding direction F, the creasing mechanism 33 for creasing the paper P, the sensors 34 for detecting the deviation of the paper P with respect to the feeding direction F, and the aligning mechanism 35 which, based on the result of the detection by the sensors 34, causes the creasing mechanism 33 to revolve in such a way that the creasing mechanism 33 is aligned with the paper P.

Also, the creasing method of the embodiment being a creasing method used in the creasing device 16, which is equipped with the creasing mechanism for creasing the paper P, the detection sensors which detect the deviation of the paper P with respect to the feeding direction F, and the aligning mechanism which causes the creasing unit to revolve, it detects, by means of the detection sensors, the deviation (the amount of skew) with respect to a feeding direction of the paper P fed toward the feeding direction F and, as well as stopping the feeding of the paper P, after causing the creasing mechanism to revolve in relation to the deviation (the amount of skew) of the paper P, and aligning the traveling direction of the creasing mechanism 33 and a paper folding direction parallel on the paper P by means of the aligning mechanism, it creases the paper P by means of the creasing mechanism.

According to these configurations, as it is possible to crease the paper P in advance, prior to applying the folding process to the paper P, it is possible to make sharper a folding angle of a folded over portion of the paper P. By this means, it is possible to improve a visual appearance when finished the paper P on which the folding process has been carried out. Furthermore, in the event that the paper P deviates with respect to the feeding direction, as the configuration is such as to cause the creasing mechanism 33 to revolve, it is not necessary to cause the pair of rollers of the feeding mechanism 32 and the like to rotate. By the crease line 48 being formed, the folding in half can be done easily. In comparison with a existing type of post-processing apparatus which, in order to improve a visual appearance and fineness of a fold, causes a pair of fold reinforcing rollers, on a downstream side of a pair of folding rollers, to rotate, it is possible to simplify a structure and reduce the sizes of the post-processing apparatus 11.

In this case, the creasing device 16 is formed separately from the folding process device. According to this configuration, it is possible to provide the creasing device 16 to a customer as an option. By this means, it is possible to provide the customer with the freedom to choose the improvement in the visual appearance or a low price.

In this case, the creasing mechanism 33 includes the disc-shaped creasing blade 38 which moves while rotating on the paper P, and forms the crease in the paper P. According to this configuration, it is possible to easily and compactly realize a structure which creases the paper P.

In this case, the creasing mechanism 33 includes the attachment unit 37 to which the plurality of creasing blades 38 of different kinds can be mounted. According to this configuration, by mounting the creasing blades 38 of different kinds to the attachment unit 37, it is possible to make a required crease in accordance with an application.

Figure 6:
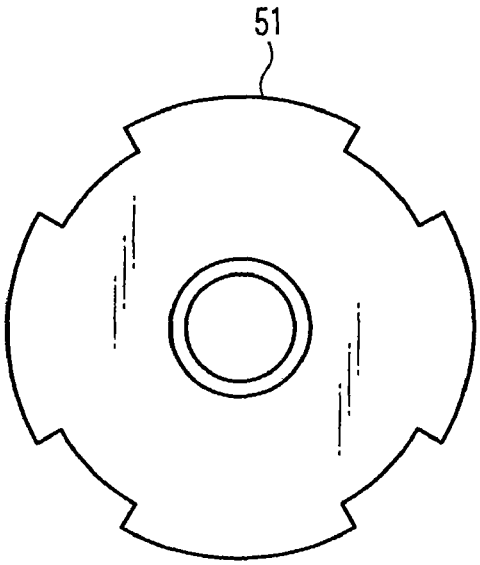
FIG. 6 is a front view showing a first rotary disc blade mounted on an attachment unit of the creasing device shown in FIG. 2.
Figure 7:
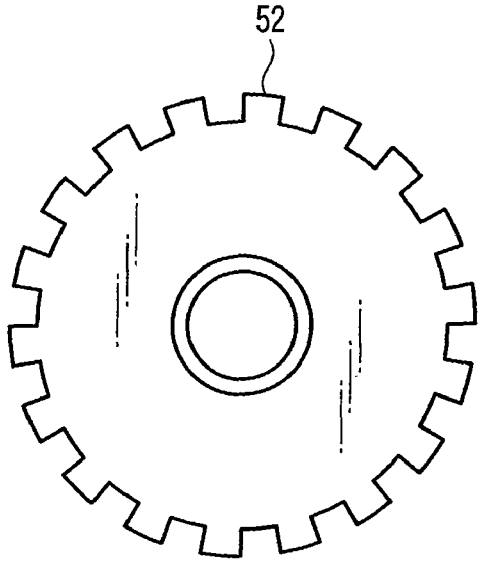
FIG. 7 is a front view showing a second rotary disc blade mounted on the attachment unit of the creasing device shown in FIG. 2.
Figure 8:
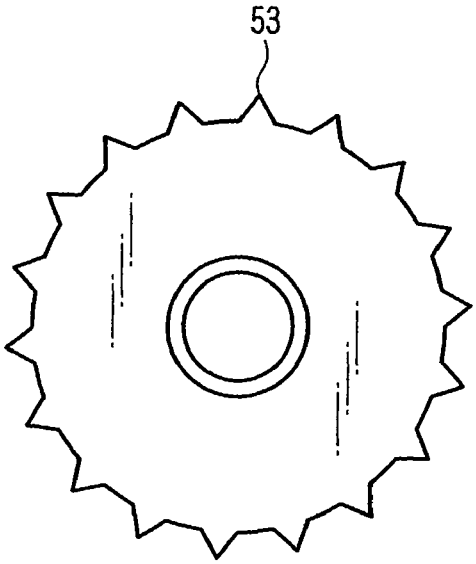
FIG. 8 is a front view showing a third rotary disc blade mounted on the attachment unit of the creasing device shown in FIG. 2.

More specifically, in place of the disc-shaped creasing blade 38, as shown in FIG. 6 or 7, it is possible to mount a rotary disc blade, which forms a perforated line on the paper P, on the attachment unit 37. In this case, by using a first rotary disc blade 51 shown in FIG. 6, it is possible to form a perforated line with a large pitch on the paper P. By using a second rotary disc blade 52 shown in FIG. 7, it is possible to form a perforated line with a small pitch on the paper P. By using a third rotary disc blade 53 shown in FIG. 8, it is possible to form a perforated line with the smallest pitch on the paper P. By using the rotary disc cutters 51, 52 and 53, it is possible to easily form a tear-off line on the paper P. The rotary disc cutters 51, 52 and 53 are included in a concept of the creasing blade as referred to in the invention.

In this case, the creasing mechanism 33 includes the spring mechanism 43 that elastically supports the disc-shaped creasing blade 38. According to this configuration, it is possible to press the creasing blade 38 against the paper P at a constant pressure. By this means, it is possible to reliably form the crease on the paper P without causing the creasing blade 38 to come up off the paper P.

In this case, the creasing blade 38 forms one crease line 48 in the central portion of the paper. According to this configuration, it is possible to form a crease suited to folding (center folding) the paper P in half.

In this case, the creasing blade 38 forms a crease line 48 in each of the central portion of the paper P, and another portion away from the central portion. According to this configuration, for example, it is possible to form creases 48 suited to accordion folding the paper P.

Next, a description will be given, using FIG. 1, of a printing method including the crease line or the tear-off line which is one aspect of the embodiment of the invention. In the MFP 10, the crease line or tear-off line is formed on the printed paper P by the above-described creasing device 16. The paper P on which the crease line 48 or tear-off line has been formed is discharged, via the entrance conveying path 13 and second conveying path 13*a* of the post-processing apparatus 11, into the second discharge tray 25. By this means, it is possible to provide extremely versatile printing paper which has the crease line or the tear-off line on the paper P.

Although the embodiment is described based on the aligning mechanism which aligns the creasing mechanism 33 in a crease line direction of the paper P, it is also acceptable that a configuration is such as to, including an aligning mechanism which aligns a paper P central line and a paper conveying direction by providing an aligning member which is movable in a paper width direction for adjusting relative positions of the paper and the creasing mechanism 33 based on paper P deviation information, after aligning the traveling direction of the creasing mechanism 33 and the crease direction of the paper 33 in parallel, cause the creasing mechanism to run and form the crease line.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A creasing device, comprising:

a feeding mechanism configured to feed paper on which an image is formed in a feeding direction;

a creasing unit configured to make a crease on the paper without folding the paper, in a direction substantially orthogonal to the feeding direction;

sensors configured to detect a deviation of the paper with respect to the feeding direction; and an aligning mechanism which, based on a result of a detection by the sensors, causes the creasing unit to rotate in such a way that the creasing unit is aligned with the paper.

2. The creasing device according to claim 1, wherein the creasing unit includes a disc-shaped creasing blade which moves over the paper while rotating and forms a crease on the paper.

3. The creasing device according to claim 2, wherein the creasing unit includes an attachment unit to which a plurality of creasing blades of different kinds are mounted.

4. The creasing device according to claim 3, wherein the creasing unit includes a spring mechanism which elastically supports the disc-shaped creasing blade.

5. The creasing device according to claim 4, wherein the creasing blade forms one crease in a central portion of the paper.

6. The creasing device according to claim 4, wherein the creasing blade forms a crease in each of the central portion of the paper, and another portion away from the central portion.

7. A creasing method, used in a creasing device including:

a creasing mechanism configured to make a crease on paper;

detection sensors which detect a deviation of the paper with respect to a feeding direction; and an aligning mechanism which causes the creasing mechanism to rotate, wherein the creasing method detects, by the detection sensors, the deviation with respect to the feeding direction of the paper fed toward the feeding direction, stops the feeding of the paper, and, after causing the creasing mechanism to revolve in relation to the deviation of the paper and aligning the creasing mechanism parallel to a fold direction of the paper by the aligning mechanism, creases the paper without folding the paper, in a direction substantially orthogonal to the feeding direction by the creasing mechanism.

* * * * *